US010745189B2

(12) United States Patent
Helie et al.

(10) Patent No.: US 10,745,189 B2
(45) Date of Patent: Aug. 18, 2020

(54) METERING VALVE AND FLUID PRODUCT DISPENSING DEVICE COMPRISING SUCH A VALVE

(71) Applicant: APTAR FRANCE SAS, Le Neubourg (FR)

(72) Inventors: Arnaud Helie, La Saussaye (FR); Fabien Chabilan, Amfreville la Mi Voie (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/078,429

(22) PCT Filed: Mar. 20, 2017

(86) PCT No.: PCT/FR2017/050644
§ 371 (c)(1),
(2) Date: Aug. 21, 2018

(87) PCT Pub. No.: WO2017/162972
PCT Pub. Date: Sep. 28, 2017

(65) Prior Publication Data

US 2019/0047778 A1 Feb. 14, 2019

(30) Foreign Application Priority Data

Mar. 23, 2016 (FR) ..... 16 52468

(51) Int. Cl.
*B65D 83/54* (2006.01)

(52) U.S. Cl.
CPC ..... *B65D 83/54* (2013.01)

(58) Field of Classification Search
CPC ..... B65D 83/54–546; B65D 83/48
See application file for complete search history.

(56) References Cited

U.S. PATENT DOCUMENTS 2,900,114 A * 8/1959 Utz ..... B65D 83/48 222/402.24
3,074,601 A * 1/1963 Kuffer ..... B65D 83/44 222/402.24

(Continued)

FOREIGN PATENT DOCUMENTS

| | | |
|---|---|---|
| EP | 0 551 782 A1 | 7/1993 |
| EP | 0 916 596 A1 | 5/1999 |
| FR | 2 860 503 A1 | 4/2005 |

OTHER PUBLICATIONS

International Search Report for PCT/FR2017/050644 dated Jul. 21, 2017 [PCT/Isa/210].

(Continued)

*Primary Examiner* — Paul R Durand
*Assistant Examiner* — Randall A Gruby
(74) *Attorney, Agent, or Firm* — Sughrue Mion, PLLC

(57) ABSTRACT

A metering valve for dispensing fluid, the metering valve comprising: a valve body (10) containing a metering chamber (20); and a valve member (30) that slides axially in said valve body (10) between a rest position and a dispensing position, for selectively dispensing the contents of said metering chamber (20); said valve member (30) including a collar (320) and being urged towards its rest position by a spring (8) that co-operates firstly with said valve body (10) and secondly with said valve member (30), said valve body (10) including a valve-body cylindrical portion (15) in which said collar (320) of said valve member (30) slides between its rest and dispensing positions, said valve-body cylindrical portion (15) including a plurality of longitudinal splines (100) that extend over at least a fraction of the height of said valve-body cylindrical portion (15), said longitudinal splines (100) projecting radially inwards and acting on said collar (320) of said valve member (30) for substantially (Continued)

centering said collar (320) in said valve-body cylindrical portion (15).

14 Claims, 2 Drawing Sheets

(56) References Cited

U.S. PATENT DOCUMENTS 3,547,317 A * 12/1970 Green ..... B65D 83/425 222/402.2
3,640,436 A * 2/1972 Gallagher ..... B65D 83/425 222/402.24
3,738,542 A 6/1973 Ruscitti
3,977,576 A * 8/1976 Amabili ..... B65D 83/48 222/402.1
4,413,755 A * 11/1983 Brunet ..... B65D 83/54 222/402.2
4,466,838 A * 8/1984 Heeb ..... C09K 3/30 106/311
4,702,400 A * 10/1987 Corbett ..... G01F 11/32 222/402.2
4,953,759 A * 9/1990 Schmidt ..... B65D 83/54 222/402.2
5,037,012 A * 8/1991 Langford ..... B05B 15/20 222/402.2
5,169,038 A * 12/1992 Di Giovanni ..... B65D 83/54 222/402.2
5,593,069 A * 1/1997 Jinks ..... B65D 83/54 222/246
5,632,421 A 5/1997 Colombo
5,904,274 A * 5/1999 Warby ..... B65D 83/54 222/402.2
6,112,950 A * 9/2000 Di Giovanni ..... F16K 25/005 222/402.1
6,129,247 A * 10/2000 Thomas ..... B65D 83/48 222/402.1
6,170,717 B1 * 1/2001 Di Giovanni ..... C21B 13/14 222/402.2
6,196,276 B1 * 3/2001 De Laforcade ..... B65D 83/425 141/20
6,318,603 B1 * 11/2001 Burt ..... B65D 83/54 222/402.1
6,345,740 B1 * 2/2002 Riebe ..... B65D 83/38 222/402.1
6,596,260 B1 * 7/2003 Brugger ..... A61K 9/008 128/200.24
6,644,306 B1 * 11/2003 Riebe ..... A61M 15/009 128/200.23
6,843,392 B1 * 1/2005 Walker ..... B65D 83/54 222/402.1
6,926,178 B1 * 8/2005 Anderson ..... B65D 83/48 222/402.2
6,983,743 B2 * 1/2006 Hoelz ..... A61M 15/009 128/200.23
7,278,556 B2 * 10/2007 Goujon ..... B65D 83/54 222/402.1
7,959,042 B2 * 6/2011 Twyman ..... B65D 83/54 137/627.5
8,408,431 B2 * 4/2013 Fontela ..... B65D 83/54 222/402.2
8,434,648 B2 * 5/2013 Marie ..... B65D 83/36 222/402.1
8,820,588 B2 * 9/2014 Ghavami-Nasr ..... B65D 83/54 222/402.2
10,029,844 B2 * 7/2018 Seki ..... B65D 83/38
10,364,898 B2 * 7/2019 Petit ..... B65D 83/54
10,399,767 B2 * 9/2019 Plaschkes ..... B65D 83/42
10,421,599 B2 * 9/2019 Jacuk ..... B65D 83/54
2002/0079337 A1 * 6/2002 Jinks ..... B65D 83/54 222/402.2
2003/0180228 A1 * 9/2003 Cripps ..... B65D 77/003 424/46
2004/0035417 A1 * 2/2004 Ottolangui ..... B65D 83/38 128/202.17
2004/0129737 A1 * 7/2004 Anderson ..... B65D 83/48 222/402.24
2006/0249543 A1 * 11/2006 Pardonge ..... B65D 83/38 222/402.1
2007/0131722 A1 * 6/2007 Goujon ..... B65D 83/54 222/402.2
2007/0145081 A1 * 6/2007 Goujon ..... B65D 83/54 222/402.2
2009/0008584 A1 * 1/2009 Fontela ..... B65D 83/38 251/118
2010/0051651 A1 * 3/2010 Allsop ..... B65D 83/425 222/402.2
2010/0258757 A1 * 10/2010 Fontela ..... B65D 83/54 251/321
2010/0300437 A1 * 12/2010 Sivigny ..... B65D 83/48 128/203.12
2012/0160878 A1 * 6/2012 Burel ..... B65D 83/38 222/402.2
2014/0027475 A1 * 1/2014 Jacuk ..... B65D 83/38 222/402.1
2014/0231466 A1 * 8/2014 Du Boisbaudry .. B05B 11/3047 222/402.1
2018/0134481 A1 * 5/2018 Bodet ..... B65D 83/38

OTHER PUBLICATIONS

English Translation of the International Preliminary Report on Patentability dated Sep. 27, 2018 in counterpart international application No. PCT/FR2017/050644.

* cited by examiner

METERING VALVE AND FLUID PRODUCT DISPENSING DEVICE COMPRISING SUCH A VALVE

CROSS REFERENCE TO RELATED APPLICATIONS

This application is a National Stage of International Application No. PCT/FR2017/050644 filed Mar. 20, 2017, claiming priority based on French Patent Application No. 1652468 filed Mar. 23, 2016.

The present invention relates to a metering valve and to a fluid dispenser device including such a valve.

"Metering valves" in which an accurate dose of fluid is dispensed each time the valve is actuated are well known in the prior art, and they are generally assembled on a reservoir containing the fluid and a propellant gas that is used to expel the dose.

Two types of metering valves are known in particular.

Retention valves include a valve member that, in the rest position, close the metering chamber in part. More precisely, the outside of the valve member co-operates in leaktight manner with the chamber gasket of the metering chamber such that, in the rest position, the metering chamber is connected to the reservoir only via the internal channel of the valve member.

"Primeless" valves or ACT valves fill only just before actuation proper.

For retention valves, a problem may occur of a dose being incomplete when it is expelled, in particular after the valve has been stored for a certain time in the upright position, with the valve arranged above the reservoir. It can then happen that a fraction of the dose returns into the reservoir via the internal channel of the valve member, despite the more or less complicated shape of the internal channel.

Documents EP 0 551 782, U.S. Pat. No. 3,738,542, FR 2 860 503, U.S. Pat. No. 5,632,421, and EP 0 916 596 describe prior-art retention valves.

An object of the present invention is to improve the metering valves of the retention type.

A particular object of the present invention is to provide a metering valve that is simple and inexpensive to manufacture and to assemble, and that is reliable in operation.

Another object of the present invention is to provide a metering valve that guarantees good reliability of operation for said valve.

The present invention thus provides a metering valve for dispensing fluid, the metering valve comprising: a valve body containing a metering chamber; and a valve member that slides axially in said valve body between a rest position and a dispensing position, for selectively dispensing the contents of said metering chamber; said valve member including a collar and being urged towards its rest position by a spring that co-operates firstly with said valve body and secondly with said valve member, said valve body including a valve-body cylindrical portion in which said collar of said valve member slides between its rest and dispensing positions, said valve-body cylindrical portion including a plurality of longitudinal splines that extend over at least a fraction of the height of said valve-body cylindrical portion, said longitudinal splines projecting radially inwards and acting on said collar of said valve member for substantially centering said collar in said valve-body cylindrical portion.

Advantageously, said valve-body cylindrical portion includes at least three, advantageously six, longitudinal splines.

Advantageously, each longitudinal spline has a rounded shape so as to minimize areas of contact with said collar.

Advantageously, said valve member including an internal channel for filling said metering chamber after each actuation of the metering valve, said valve-body cylindrical portion containing a second chamber that is defined between said collar and said metering chamber, said second chamber being connected, in the rest position, to said metering chamber via said internal channel.

Advantageously, the difference between the inside diameter of said valve-body cylindrical portion and the outside diameter of said collar is less than 0.2 millimeters (mm), preferably less than 0.15 mm, such that in the rest position of the valve, the fluid contained in said second chamber is substantially retained in said second chamber, said longitudinal splines having a radial dimension d2 that is less than 0.1 mm, preferably less than 0.09 mm, advantageously about 0.07 mm, such that the peripheral radial offset between said collar and said longitudinal splines is less than 0.06 mm, advantageously less than 0.02 mm. Advantageously, said difference between the diameters is greater than 0.01 mm, in particular equal to at least 0.04 mm.

Advantageously, said longitudinal splines have a radial dimension that decreases, with a maximum radial dimension d2 at the rest position of said collar, and a minimum radial dimension at the dispensing position of said collar.

The present invention also provides a fluid dispenser device comprising a metering valve as defined above, fastened on a reservoir.

These characteristics and advantages and others of the present invention appear more clearly from the following detailed description thereof, given by way of non-limiting examples, and with reference to the accompanying drawings, and in which.

In the following description, the terms "upper", "lower", "top" and "bottom" refer to the upright position shown in FIG. 1, and the terms "axial" and "radial" refer to the longitudinal axis B of the valve shown in FIG. 1.

Figure 1:
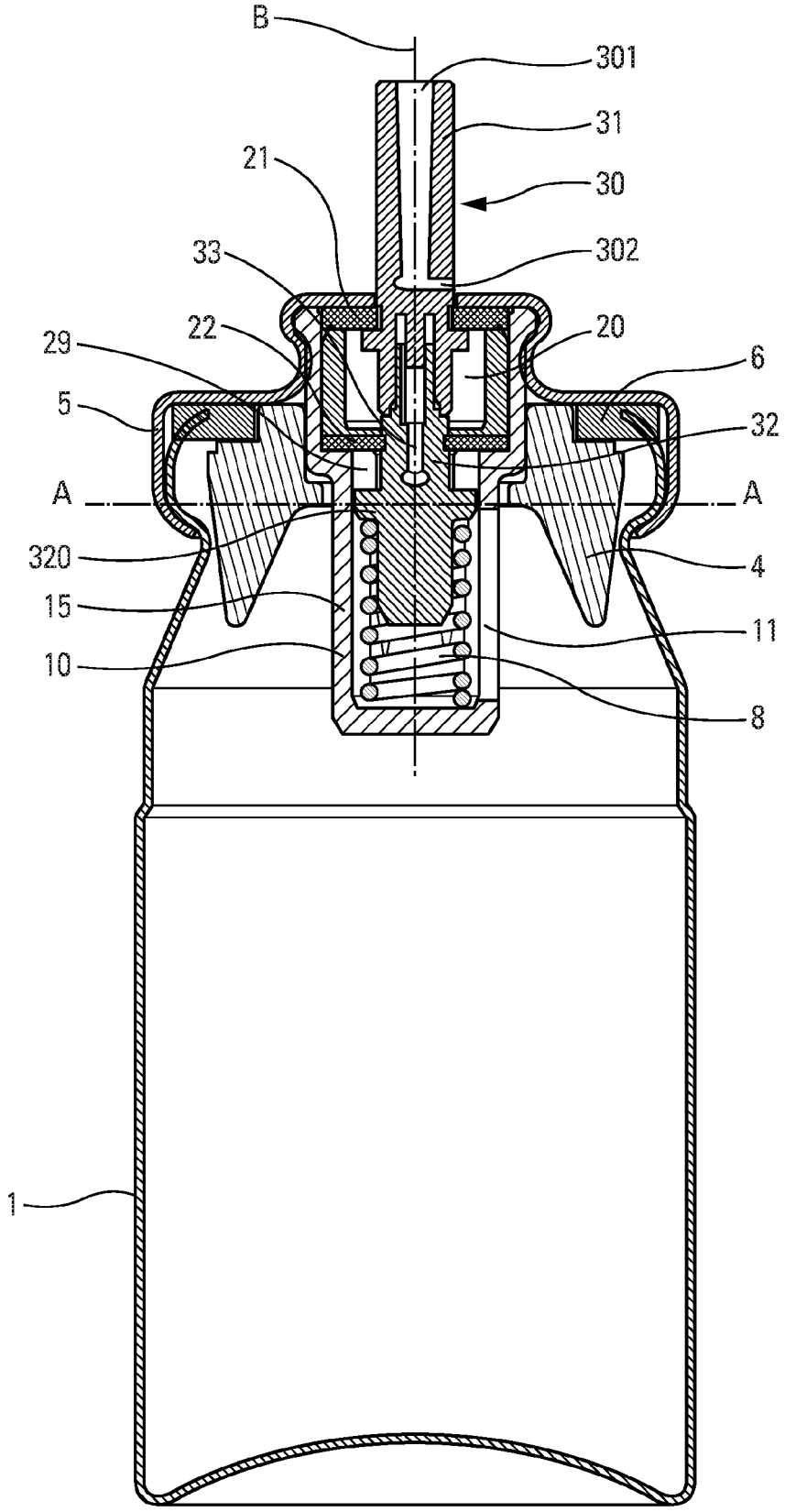
FIG. 1 is a diagrammatic section view of a dispenser valve in the rest position of the valve member, in the upright storage position of the valve.

The metering valve of the retention type shown in FIG. 1 includes a valve body 10 that extends along a longitudinal axis B. Inside said valve body 10, a valve member 30 slides between a rest position, that is the position shown in the FIG. 1, and a dispensing position in which the valve member 30 has been pushed into the valve body 10.

The valve is for assembling on a reservoir 1, preferably by means of a fastener element 5 that may be a crimpable, screw-fastenable, or snap-fastenable capsule, and a neck gasket 6 is advantageously interposed between the fastener element and the reservoir. Optionally, a ring 4 may be assembled around the valve body, in particular so as to decrease the dead volume in the upsidedown position, and so as to limit contact between the fluid and the neck gasket. The ring may be of any shape, and the example in FIG. 1 is not limiting.

The valve member 30 is urged towards its rest position by a spring 8 that is arranged in the valve body 10 and that co-operates firstly with the valve body 10 and secondly with the valve member 30, preferably with a radial collar 320 of the valve member 30. A metering chamber 20 is defined inside the valve body 10, said valve member 30 sliding inside said metering chamber so as to enable its contents to be dispensed when the valve is actuated.

In conventional manner, the metering chamber is preferably defined between two annular gaskets, namely a valve-member gasket 21, and a chamber gasket 22.

FIG. 1 shows the valve in the upright storage position, i.e. the position in which the metering chamber 20 is arranged above the reservoir 1.

The valve member 30 includes an outlet orifice 301 that is connected to an inlet orifice 302 that is arranged in the metering chamber 20 when the valve member 30 is in its dispensing position. The valve member 30 may be made of two portions, namely an upper portion 31 (also known as a valve-member top) and a lower portion 32 (also known as a valve-member bottom). In this embodiment, the lower portion 32 is assembled inside the upper portion 31. An internal channel 33 is provided in the valve member 30 that makes it possible to connect the metering chamber 20 to the reservoir 1, so as to fill said metering chamber 20 after each actuation of the valve when the valve member 30 returns to its rest position under the effect of the spring 8. Filling is performed when the device is still in its upsidedown working position, with the valve arranged below the reservoir.

As shown in FIG. 1, when the valve member 30 is in its rest position, the metering chamber 20, outside the valve member 30, is substantially isolated from the reservoir by cooperation between the lower portion 32 of the valve member 30 and the chamber gasket 22. In the rest position, the metering chamber 20 thus remains connected to the reservoir 1 merely via said internal channel 33.

The valve body 10 includes a cylindrical portion 15 in which the spring 8 is arranged, and in which the collar 320 slides between its rest and dispensing positions. In the position in FIG. 1, the cylindrical portion 15 is the bottom portion of the valve body. The cylindrical portion 15 includes one or more longitudinal openings 11, such as slots, that extend sideways in said cylindrical portion 15 of the valve body, over a fraction of the axial height of the valve body in the direction of the longitudinal central axis B. The openings make it possible to fill the metering chamber after each actuation in the upsidedown working position (with the valve arranged below the reservoir) when the valve member 30 returns from its dispensing position to its rest position.

In the rest position, the collar 320 of the valve member defines a second chamber 29 that is defined between said collar 320 and the metering chamber 20. More precisely, with reference to FIG. 1, the second chamber 29 is arranged below the chamber gasket 22 and above the collar 320 of the valve member 30. The second chamber 29 empties automatically by gravity when in the upright storage position via the functional clearance between the outside of the collar 320 and the inside diameter of said cylindrical portion 15 of the valve body.

A known problem with metering valves is the loss-of-dose phenomenon, also known as "drainback". The loss of dose is evaluated in particular by the "Loss of Prime" test consisting in weighing the dose after expulsion at storage intervals lying in the range three days to seven days, typically five days. Analysis has shown that, while in the storage position (upright position in FIG. 1), the metering chamber 20 of the valve may empty, at least in part, via the internal channel 33 of the valve member 30, when said second chamber 29 of the valve is empty.

Research has served to determine that the emptying of the second chamber 29 is slowed down, or even eliminated, as a function of the size of the functional clearance or of the exchange area at the interface between the collar 320 and the inside diameter of said cylindrical portion 15 of the valve body. In particular, centering the valve member in the valve body turns out to be favorable.

Figure 2:
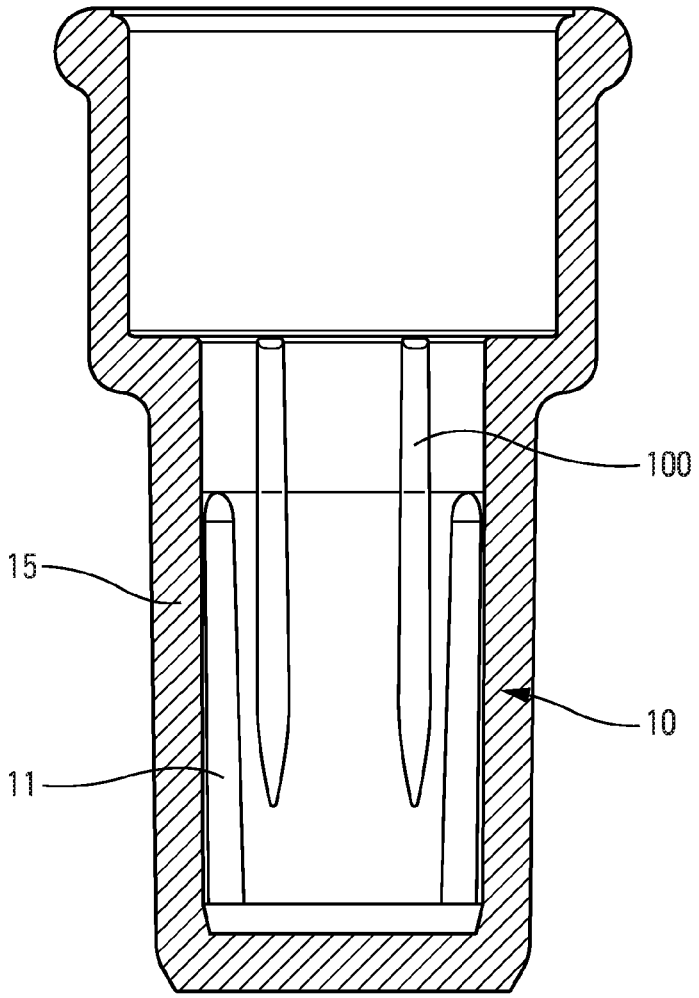
FIG. 2 is a detail view of the valve body, in an advantageous embodiment of the invention.
Figure 3:
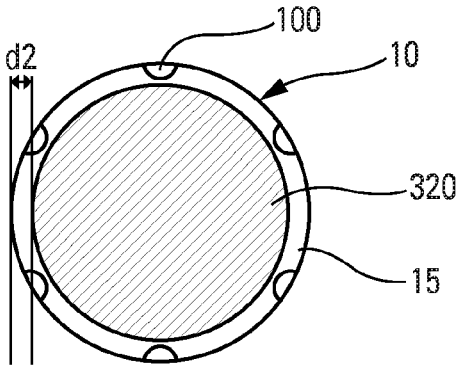
FIG. 3 is a detail view in section on section plane A-A in FIG. 1 showing a valve body in the embodiment in FIG. 2.

FIGS. 2 and 3 show an embodiment of the invention in which said collar 320 of the valve member 30 is substantially centered in the cylindrical portion 15 of the valve body. Centering makes it possible to distribute the clearance between the collar 320 and the valve body over the entire periphery. The area through which the formulation passes is improved, and this improves the filling of the metering chamber 20.

In order to center the valve member 30 in the cylindrical portion 15 of the valve body, the cylindrical portion includes longitudinal splines 100. Advantageously, at least three splines are provided, and in particular six as shown in FIG. 43. The longitudinal splines 100 extend over at least a fraction of the height of said valve-body cylindrical portion 15, projecting radially inwards. They thus act on said collar 320 of said valve member 30 so as to position said collar 320 substantially centrally in said valve-body cylindrical portion 15. Advantageously, each longitudinal spline 100 has a rounded shape so as to minimize area of contact with said collar 320.

Advantageously, the difference between the inside diameter of said valve-body cylindrical portion 15 and the outside diameter of said collar 320 is less than 0.2 mm, preferably less than 0.15 mm. With longitudinal splines 100 that have a radial dimension d2 that is less than 0.1 mm, preferably less than 0.09 mm, advantageously about 0.07 mm, a peripheral radial offset is obtained between said collar 320 and said longitudinal splines 100 that is less than 0.06 mm, advantageously less than 0.02 mm.

Advantageously, said difference between the diameters is greater than 0.01 mm, and in particular is equal to at least 0.04 mm. This avoids any risk of blockage of the valve member, independently of manufacturing tolerances.

With such a small peripheral radial offset, emptying of the second chamber 29 is prevented or at least greatly slowed down, so that the metering chamber 20 likewise does not empty through the internal channel of the valve member.

In a variant, said longitudinal splines 100 may have a radial dimension that decreases, with a maximum radial dimension d2 at the rest position of said collar 320, and a minimum radial dimension at the dispensing position of said collar 320. In this variant, the splines 100 start from the top of the cylindrical portion 15 of the valve body until the inscribed diameter of the splines becomes the same as the inside diameter of said cylindrical portion 15. Since the splines 100 taper less than the inside diameter of said cylindrical portion 15, the two diameters end up becoming the same at a certain height in said cylindrical portion 15.

Although the present invention is described above with reference to embodiments thereof, it is clear that it is not limited by the embodiments shown. On the contrary, any useful modification could be applied thereto by a person skilled in the art, without going beyond the ambit of the present invention, as defined by the accompanying claims.

The invention claimed is:

1. A metering valve for dispensing fluid, the metering valve comprising: a valve body containing a metering chamber; and a valve member that slides axially in said valve body between a rest position and a dispensing position, for selectively dispensing contents of said metering chamber; said valve member including a collar and being urged towards its rest position by a spring that co-operates with said valve body at a first end of the spring and with said collar at a second end of the spring opposite the first end, said valve body including a valve-body cylindrical portion in which said collar of said valve member slides between its rest and dispensing positions, wherein said valve-body cylindrical portion includes a plurality of longitudinal splines that extend over at least a fraction of the height of said valve-body cylindrical portion, said longitudinal splines projecting radially inwards;

wherein said valve member includes a channel for filling said metering chamber after each actuation of the metering valve, said valve-body cylindrical portion containing a second chamber that is defined between said collar and said metering chamber, said second chamber being connected, in the rest position, to said metering chamber via said channel: and wherein a difference between an inside diameter of said valve-body cylindrical portion and an outside diameter of said collar is less than 0.2 mm, such that in the rest position of the valve, a fluid contained in said second chamber is substantially retained in said second chamber, said longitudinal splines having a radial dimension that is less than 0.1 mm, such that a peripheral radial offset between said collar and said longitudinal splines is less than 0.06 mm.

2. A valve according to claim 1, wherein said valve-body cylindrical portion includes at least three longitudinal splines.

3. A valve according to claim 1, wherein each longitudinal spline has a rounded shape so as to minimize the areas of contact with said collar.

4. A valve according to claim 1, wherein said difference between the diameters is greater than 0.01 mm.

5. A valve according to claim 1, wherein said longitudinal splines have a radial dimension that decreases, with a maximum radial dimension at the rest position of said collar, and a minimum radial dimension at the dispensing position of said collar.

6. The valve according to claim 1, wherein said plurality of longitudinal splines comprises six longitudinal splines.

7. The valve according to claim 1, wherein the difference between the inside diameter of said valve-body cylindrical portion and the outside diameter of said collar is less than 0.15 mm.

8. The valve according to claim 1, wherein a radial dimension of each of said longitudinal splines is less than 0.09 mm.

9. The valve according to claim 8, wherein a peripheral radial offset between said collar and each of said longitudinal splines is less than 0.02 mm.

10. The valve according to claim 1, wherein a radial dimension f each of said longitudinal splines is less than about 0.07 mm.

11. The valve according to claim 10, wherein the peripheral radial offset between said collar and each of said longitudinal splines is less than 0.02 mm.

12. The valve according to claim 1, wherein a peripheral radial offset between said collar and each of said longitudinal splines is less than 0.02 mm.

13. The valve according to claim 1, wherein said difference between the diameters is at least 0.04 mm.

14. A fluid dispenser device, comprising a metering valve according to claim 1 fastened on a reservoir.

* * * * *